United States Patent [19]

Dieringer et al.

[11] 4,047,280

[45] Sept. 13, 1977

[54] METHOD FOR REMOVING TIES UNDER RAILROAD TRACK

[75] Inventors: Andrew M. Dieringer, Waterford; Ervin M. Sheperd, Milwaukee, both of Wis.

[73] Assignee: Rexnord Inc., Milwaukee, Wis.

[21] Appl. No.: 711,804

[22] Filed: Aug. 5, 1976

Related U.S. Application Data

[63] Continuation of Ser. No. 452,007, March 18, 1974, abandoned.

[51] Int. Cl.[2] ..... B23P 19/02

[52] U.S. Cl. ..... 29/427; 83/5; 104/9; 144/193 A

[58] Field of Search ..... 104/6, 9; 29/426, 427; 83/5; 144/192, 193, 193 A; 254/43, 44

[56] References Cited

U.S. PATENT DOCUMENTS

| | | | |
|---|---|---|---|
| 52,215 | 1/1866 | Silkman | 144/193 |
| 2,474,037 | 6/1949 | Cuthrell | 144/193 |
| 2,527,668 | 10/1950 | Woolery | 83/5 |
| 2,712,841 | 7/1955 | Simmons et al. | 83/5 |
| 3,496,883 | 2/1970 | Bodine | 104/9 |
| 3,537,400 | 11/1970 | Taylor | 104/9 |
| 3,675,580 | 7/1972 | Kershaw | 104/9 |
| 3,698,324 | 10/1972 | Peppin et al. | 104/9 |
| 3,881,422 | 5/1975 | Bryan | 104/9 |

*Primary Examiner*—James R. Duzan

*Attorney, Agent, or Firm*—Kinzer, Plyer, Dorn & McEachran

[57] ABSTRACT

This is a method and apparatus for removing ties from under railroad track and is specifically concerned with removing ties in one piece and involves removing the high wood from the ties in the area between the rails of the track and on one end thereof so that the tie may be pulled or pushed out the other way.

32 Claims, 5 Drawing Figures

10
12
14
16
20
22
24
30
32
34
40
44
46
47
48
50
52
53
54
58
66
68
70
72
74
76
78
80
82
84
86
88
90
92
98
100
124
126
128
130
132
134
140
142
144
146
147
X
3
3

METHOD FOR REMOVING TIES UNDER RAILROAD TRACK

This is a continuation of Ser. No. 452,007, filed Mar. 18, 1974, now abandoned.

SUMMARY OF THE INVENTION

This is concerned with a method and apparatus for removing ties from under railroad track in one piece and is specifically concerned with removing the ties in a manner such that the surface and line of the track will be disturbed a minimum, if any.

A primary object of the invention is a method and apparatus for removing ties from under railroad track in one piece.

Another object is a method and apparatus of the above type which involves removing the high wood from the ties between the rails and on one end thereof so that a tie can be pulled or pushed out the other way.

Another object is a method of removing the high wood from the tops of the ties in a manner so that when the tie is pulled out, there will be little resistance to its movement.

Another object is a method of removing the high wood from the tops of the tie in a manner such that the tie plates may be removed at the same time.

Another object is a method and apparatus for removing the high wood from the tops of ties in a manner that takes into consideration that they are probably old and substantially plate cut.

Another object is a method of removing the high wood from the tops of old ties so that they can be removed in one piece, which involves gauging down from the tops of the rails to a distance below the bottom of the rail but above the bottom of the tie plates so that when a tie is subsequently pulled or pushed out, none of the high wood will be hanging onto the tie, nor will there be any interference with the bottom of the rails.

Another object is a method of removing ties from under railroad tracks in one piece in which the high wood and the tie plate are removed at the same time and, in a sense, in one motion.

Another object is a method and apparatus which preserves the surface and line of the rails with a minimum of disturbance, if any.

Another object is a method and apparatus which does not apply a side thrust to the rail when the tie is being pulled or pushed out in one piece.

Another object is a method and apparatus which does not do any jacking of the rails when the tie is drawn or pushed out in one piece.

Another object is a method and apparatus which removes the high wood from the tops of the ties with the use of longitudinal wood-removing pressure applied thereto and, at the same time, the tie plates are pushed into the crib space between the ties.

Another object is a method and apparatus of the above type which does not require any precision cutting or shaving of the wood but, rather, may be a rough, rugged, crunching type of operation, which greatly reduces the cost of the equipment involved.

Another object is a method and apparatus for removing the high wood on the tie, which is not dependent upon or affected by the grain of the wood.

Other objects will appear from time to time in the ensuing specification and drawings.

DESCRIPTION OF THE PREFERRED EMBODIMENT

Figures 1, 4:
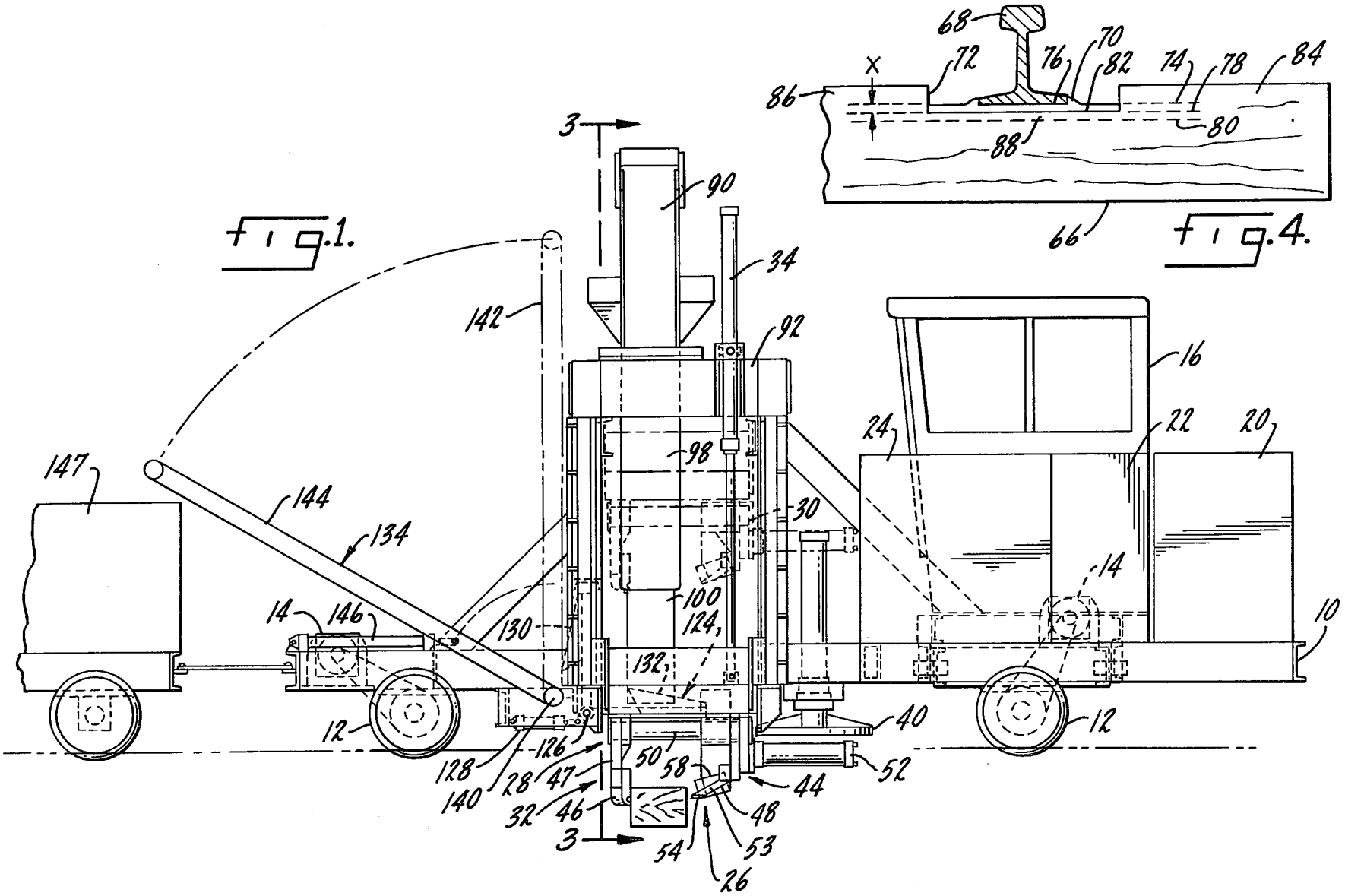
FIG. 1 is a side view of the machine.
FIG. 4 is a diagrammatic of one end of a tie.

In FIG. 1 a track-working machine has been shown which includes a conventional frame 10 made up of angle iron, channels, braces and what-have-you. The frame has axles and wheels 12 at each end which, as shown, may be individually driven hydraulically as at 14. The frame carries an operator's cab 16 on one side thereof which may house suitable controls, none of which is important here. Since it is preferred that the operating mechanism described hereinafter be hydraulically operated, the frame should also carry a tank 18 for hydraulic oil with a suitable power source, such as an engine 20 or the like which may be diesel, gasoline, or what have you. The engine may well need a fuel tank 22 which may be positioned adjacent a housing 24 for valves, all of which has been generally shown more or less in FIGS. 1 and 2.

As shown in FIG. 1, a wood cutter or remover arrangement 26 is positioned more or less in the center of the frame and includes a crosshead 28 adapted to be moved between a raised position, indicated generally at 30 in broken lines in FIG. 1 and a lower position, indicated generally at 32 in full lines. The crosshead may be raised and lowered by a cylinder 34 with the crosshead itself having a plurality of blocks or slides 36 that bear and slide against tubes or guides 38 in the center frame opening so that the crosshead will be accurately centered and controlled in its movement back and forth between its raised and lowered positions. The frame may have a turntable 40 in FIG. 1 which may be conventional.

The lower portion of the crosshead supports two pairs of jaws, a pair 42 between the rails which may be referred to as the center jaws, and a pair 44 outboard of one rail which shall be referred to as the outside jaws. The jaws or cutters are constructed to remove the high wood from the tops of the ties and will be described in detail hereinafter.

As shown in FIG. 1, each pair 42,44 includes a set of backup jaws or elements 46 which are in the form of spaced teeth or fingers mounted on a carrier 47 on one side of the crosshead opposite movable jaws 48 mounted on the other side on slide rods 50 and constructed to be closed toward the backup jaw 46 under a certain amount of pressure by a plurality of hydraulic cylinders 52. It will be noticed that the movable jaws 48 have a beveled upper face 53 and an inclined cutting edge 54 so that with the backup jaws on one side of a tie, the movable jaws will cut through the upper portion of the tie in a wood-slicing or tearing action to remove a certain amount of the high wood. The backup teeth are staggered or offset laterally somewhat to match the incline of the cutting edge 54 with grooves 46 to accept edge 54 so that it will go all the way through the wood. The machine is constructed and it is intended that both movable jaws, between the rails and outboard, move at the same time so that the high wood in both locations is removed simultaneously.

Figure 3:
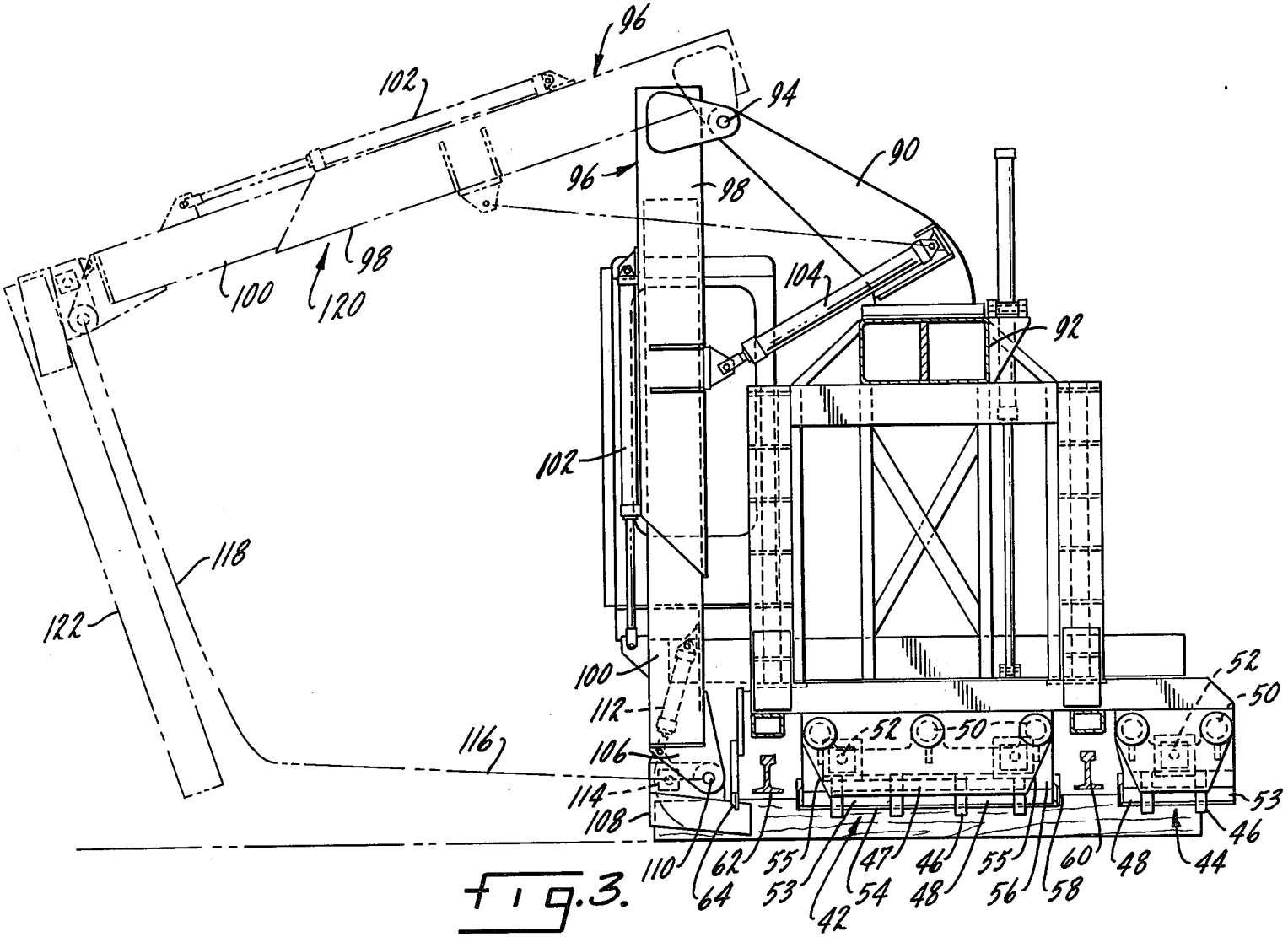
FIG. 3 is a section along line 3—3 of FIG. 1.

In FIG. 3 it will be noted that the carrier 47 for the fixed jaws 46 are tapered inwardly somewhat, as at 55, along both edges which, in effect, makes the movable jaws extend beyond the fixed jaws somewhat, as at 56. This is true of both the inboard and the outboard jaw. Plates or adaptors 58 are removably mounted on the end of the movable jaws and the dimensioning is such that these plates 58 will contact the edges of the tie plates so that as the jaws close to remove the high wood, the tie plates will be pushed longitudinally by the movable jaws. It will be understood that the spikes have been previously removed so that the tie plates are generally free to move. And since the fixed jaws are cut away, at 55, the plates will slide into the crib space between the ties. The abutment plates 58 on the movable jaws push the plate on the far rail 60 uniformly, in FIG. 3, and to prevent the tie plate under the near rail 62 from skewing. Since there are no jaws outboard of the near rail, a pusher element 64 is mounted outboard of the near rail and positioned to engage the edge of the tie plate so that it will be pushed uniformly on each side of the rail during the high wood removing process.

Figure 2:
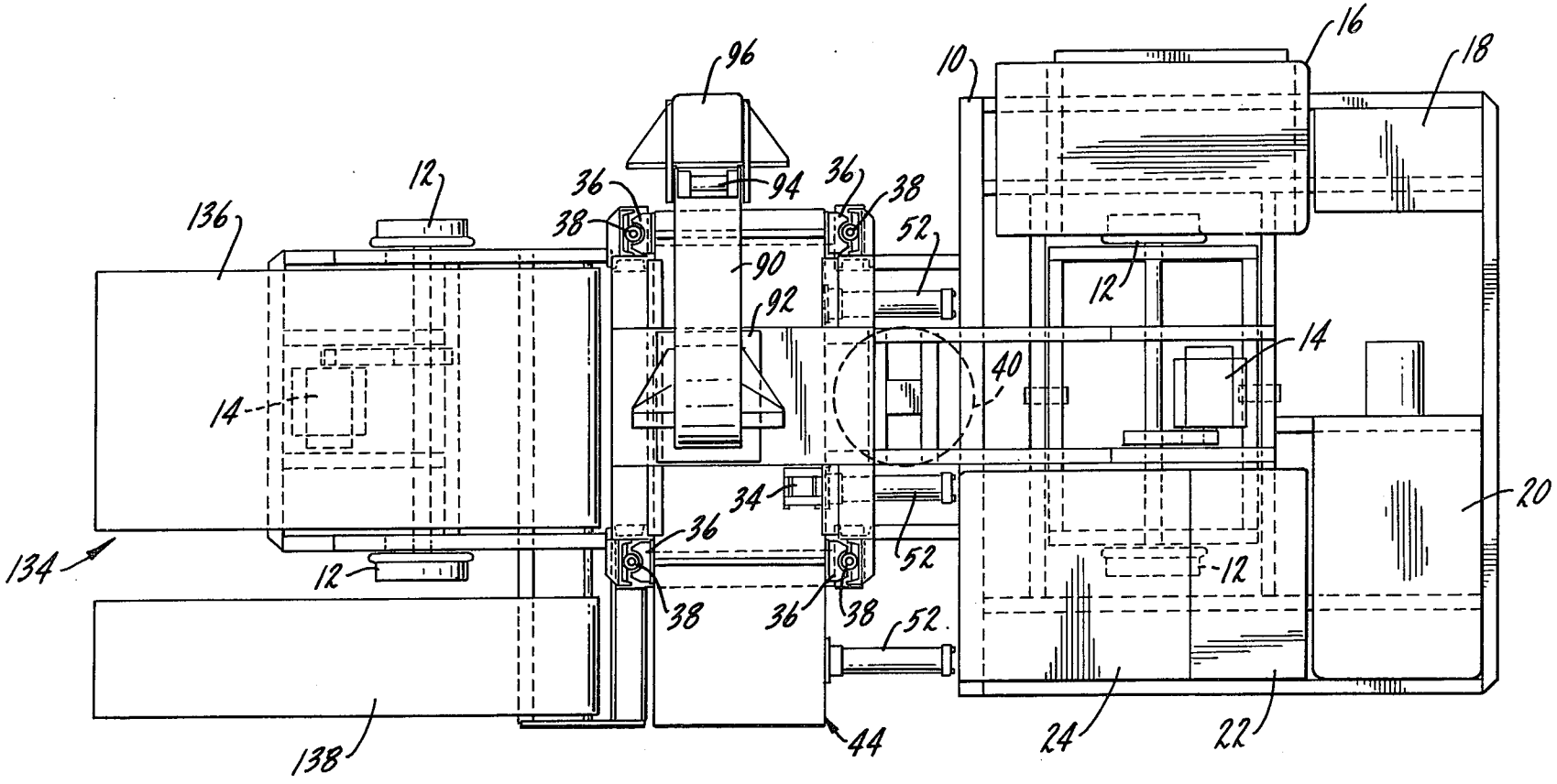
FIG. 2 is a top view of FIG. 1.

The crosshead mechanism may only need one cylinder 34 to raise and lower it and although the location of that cylinder may appear somewhat offcenter in FIG. 2, it should be remembered that the crosshead extends outboard of only one rail so the cylinder, in fact, is centered on the crosshead itself in FIG. 2. The opening and closing of the jaws will not upset the general weight relationship of the entire crosshead so that one cylinder may be used if it is disposed generally at the center of gravity of the entire crosshead mechanism.

In FIG. 4 the end of a representative tie 66 has been shown with the rail 68 on a conventional tie plate 70. The spikes have been removed. It will be noted that the tie is somewhat plate cut, as indicated at 72, which is intended to indicate that the tie is somewhat old and as traffic has passed over the track through the years, the tie plate has sunk into the tie which, on occasion, may amount to an inch or more.

The cutter or wood-removing mechanism should be gauged and set to remove the high wood down to the level of and preferably slightly above the bottom of the tie plate which is indicated by broken line 78. The wood should by all means be removed below the bottom of the rail which is indicated by broken line 74, which may also be considered to be the upper surface of the rail-supporting center surface 76 of the tie plate. The reason for going close to level 74 is so that when the tie plate is slipped out and the tie is pulled or pushed sideways to remove it, the new upper surface of the tie where the wood has been removed will be below the bottom of the rail and will have a maximum clearance and the tie, during removal, will not hit the rail base. Also, the wood should not be removed below the level 78 of the bottom surface of the tie plate so that there will be a clean break or removal of the high wood. If the wood cutting mechanism cuts below level 78, the sheared or broken wood will have a tendency to hang on to or remain connected to the wood under the tie plate area. For example, in FIG. 4 if the tie is cut down to, say, the level 80, which is below the plate cut surface 82, the sheared wood on the end 84 of the tie and between the rails, at 86, will still be connected to the wood in the area 88 under the plate cut surface. Thus, it is highly desirable to cut or shear the wood between the level 74 and 78, which is represented by the distance X. It is also desirable to perform the wood cutting or severing longitudinally or in a direction parallel to the rails, rather than laterally or across the rails. Any sort of a shearing or cutting action laterally will be difficult, at best, on the tie end and practically impossible between the rails. Further, a lateral shearing action will tend to follow the grain of the wood which, in ties, may go up or down. So it will be very difficult, if not impossible, to make sure that the high wood is removed uniformly all the way across between the levels 74 and 78 if the shear direction is lateral. A longitudinal shearing action has the advantage that the level of the shear can be quite accurately determined and controlled all the way across.

It will be noted that the high wood is removed from the center section of the tie between the rails and from only one end, not the other. This is all that is necessary since the tie may be pulled or pushed out in that direction.

In FIG. 3 a mast has been shown generally at 90 on a superstructure 92 on top of the frame and is bent or disposed to one side with a pivot 94 toward the top holding a boom 96 which may be telescopic with an outer sleeve 98 on top and an inner sleeve 100 on the bottom operated by one or more cylinders 102 so that the boom may be extended or retracted as desired. The boom is pivoted in and out by one or more cylinders 104 with the extension of the telescopic boom 96 being controlled, either in or out, by a camtype sensing mechanism which would extend or retract the telescopic boom in accordance with the pivoted position of the boom, as disclosed in U.S. Pat. No. 3,964,397 issued June 22, 1976.

The lower end of the boom may have a mounting 106 with a clamp or jaw 108 thereon pivoted at 110 by a cylinder 112.

The mast, telescopic boom and clamp on the bottom with the various operating cylinders is similar to the mast and boom arrangement shown in copending application, Serial No. 131,128. The clamp is constructed to grap the sides of the tie ends and is of rather rugged construction so that as the boom is pivoted in, the sides of the clamp will cut through or burrow in the ballast and grab the sides of the tie even though stones or other debris may be in the way. Opening and closing of the clamp may be effected by a suitable cylinder 114.

The various cylinders that operate the boom and its components may be coordinated and controlled by a circuit so that the extension of the boom is coordinated to its pivoted position. The jaw or clamp is automatically positioned to fit over the end of the tie when the boom is brought in. The clamp is automatically closed at a certain inward position of the boom. The boom extends as it pivots out pulling the tie along with it to move the pivot 110 along a planned, coordinate path, similar to or the same as the coordinate path of movement set forth in U.S. Pat. No. 3,964,397 the object being so that the end of the tie, as it is drawn out, is moved initially generally horizontally with the pivot 110 moving along line 116 and then the outer end is raised along, with the pivot 110 moving along a diagonal path 118 until it reaches a certain elevated position, indicated in broken lines generally at 120, where the tie, indicated generally at 122, may be close to vertical. At this point the clamp or jaws 108 may be released to allow the tie to fall off of the right of way.

The crosshead is lowered and the jaws closed which shears or tears the high wood from the tie, in the position 32 in FIG. 1. The shaping of the jaws or cutters is such that the high wood will be held between them while they are raised to the upper position 30 in FIG. 1. At this point a pan mechanism 124 pivoted at 126 by one or more suitable cylinders 128 may move between a vertical position, indicated generally at 130, and a horizontal position 132 under the jaw. The pan mechanism should include two portions, a large part between the rails and a small part outboard, together spanning the cutter jaws or drophead mechanism. In the horizontal position 132 of the pan the jaws would open dropping the wood and wood chips onto the pan. The cylinder 128 would then pivot the pan, counterclockwise in FIG. 1, to the 130 position at a speed such that the chips would be thrown or would fall on a conveyor mechanism 134 which may include a wide or center conveyor 136 between the rails and a somewhat narrow conveyor 138 outboard. The conveyors as a unit are pivoted at 140 so that they may be moved between a traveling, somewhat vertical position 142 and an inclined downward position 144 by one or more suitable cylinders 146. The conveyors may extend far enough so that they empty into a regular or special hopper car or container 147 which may be mounted on separate wheels and either attached to or propelled behind or in front of this unit.

Another approach is to have the conveyors mounted on a separate car projecting forwardly therefrom so that they may be inserted into the space under the cutter crosshead to receive the chips and to withdraw when the crosshead is to be lowered. They might empty into their own hopper car or a separate unit. In fact, the conveyors, as shown in FIG. 1 might be generally horizontal and mounted on a reciprocal mechanism so that they could be inserted under the crosshead to receive chips and then withdrawn to empty into a large conveyor, either mounted on the frame of the machine or pulled along separately. In this event, the pan mechanism 124 would not be necessary. But, in any event, it is important that the chips be removed and not dropped directly on the right of way. The chips might be collected in a separate bin, either on the machine or towed along with it and dumped or discharged at intervals along the right of way when full, either into a removal unit at a crossing or designated location or in a remote location somewhat distant from a yard or station.

Figure 5:
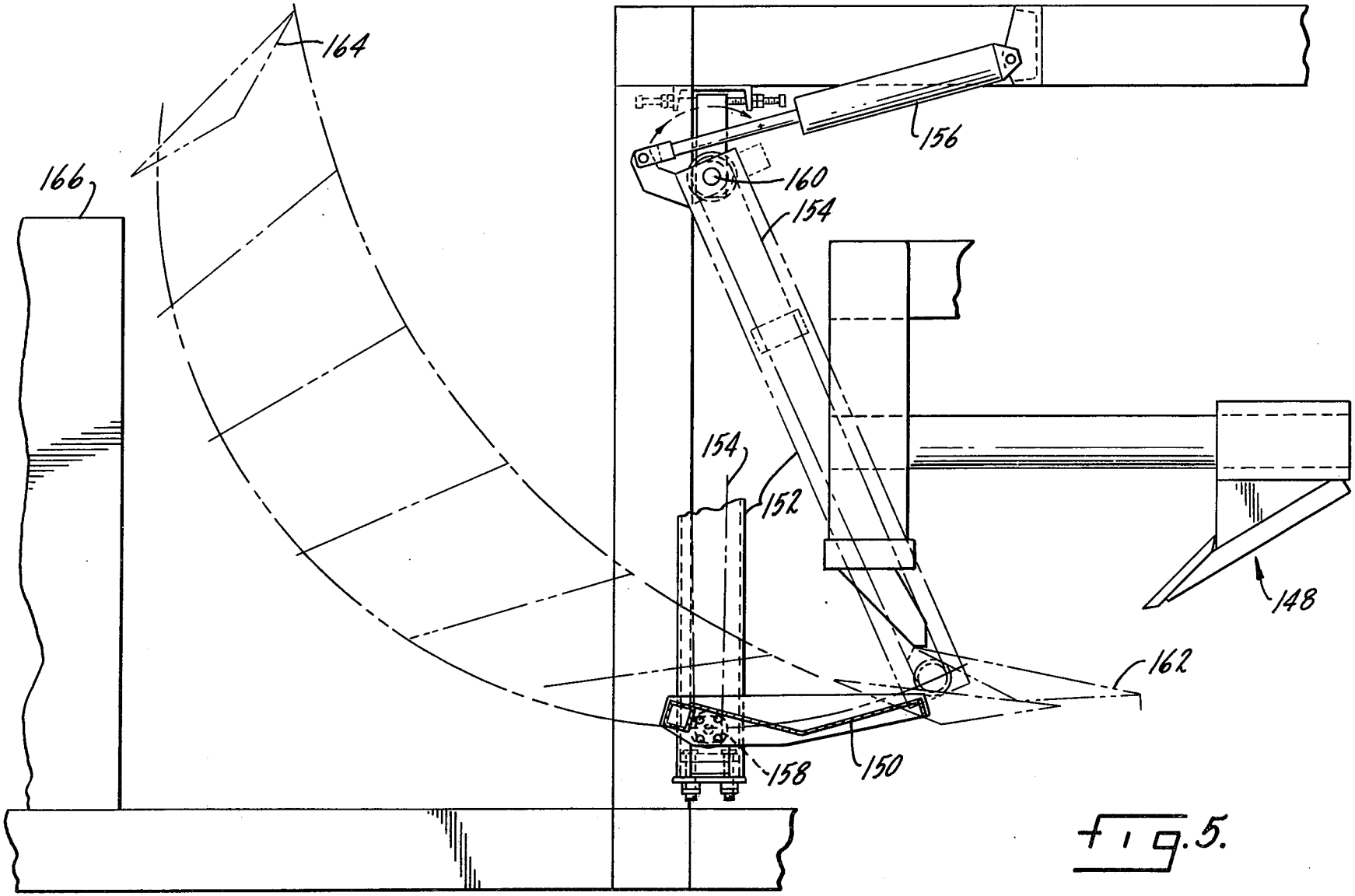
FIG. 5 is a side view, partially in section, of a modification.

Another form of the chip-disposal unit is shown in FIG. 5 in which the which cutters are diagrammatically indicated at 148 in their raised position with a chip pan at 150 mounted on pivoted arms 152 with a chaintype arrangement 154 therein and operated by a suitable cylinder 156. The pan is pivoted at the bottom of the arms, as at 158, with the arms pivoted at the top as at 160 so that as the arms swing, say, to the broken line position 162 in FIG. 5 under the cutter jaws, the pan will be horizontal or generally so. The chips may be dumped on the pan in the position 162 and then the pan and arms pivoted clockwise to a dump position indicated in broken lines at 164. Different size sprockets on pivots 158 and 160, for example a somewhat larger one at the top, cause the pan to progressively tip as the arms pivot so that it dumps when it reaches position 164 above a suitable container 166, either on the frame or separate. The pan would be in two parts, a large one between the rails and a smaller one outboard of the far rail. The linkage or chain arrangement may be such that when the pan arrives in the dump position 164 it will automatically be tilted to the degree necessary that the chips will slide off into the container. Or a separate cylinder may be used to tip it completely. But in any event, the pan can be inserted under the cutter heads to receive the chips and then withdrawn to a discharge position, thereby allowing the cutter heads to open and to descend to remove the high wood from the next tie.

The use, operation and function of the invention are as follows:

A main object is to remove the high wood from old ties so that they may thereafter be removed in one piece. HIgh wood may be thought of as the wood above the plate cut level. In the past, ties have been cut into three pieces, two ends and a middle, but this makes disposal of the pieces difficult and complicated and the resulting pieces have no value. On the other hand, a full length tie will be of value to farmers, garden groups and what have you. A full length old tie is much easier to dispose of than a bunch of broken pieces. But getting a full length tie out from under the rails is particularly difficult because a twenty or thirty year old tie is substantially plate cut. Getting such tie out normally involves jacking up the track, which is undesirable because its level will be ruined.

The object of the extractor, and the method, is to disturb the rails as little as possible, meaning that the surface and line should remain the same so that after old ties are removed and new ties have been inserted, the track does not require relining or new surfacing, which involves many men and machines and is very expensive.

The approach here is to remove the high wood down to a level between the bottom of the rail and the bottom of the tie plate. This is done by a longitudinal wood-removing process which has the advantage that the tie plates can be slipped out into the crib space at the same time. The cutting action involved does not have to be accurate or clean. Rather, the action might be more accurately described as a tearing or crunching process of the high wood which has the advantage that resharpening is very seldom necessary and the stones and ballast have no affect. The operation does not have to be a clean shave, but rather is a tearing step to the proper level. The method has the added advantage that it is quite easy to remove the tie plates at the same time, which has always been difficult with other procedures. In fact, the presence of the tie plates in the past has greatly complicated the procedure and raised the expense and difficulty of getting the tie out in one piece.

In a sense, the method involves gauging down from the top of the rails to the space between the bottom of the rails and the bottom of the tie plates. This distance is fixed and may be set for any particular machine and can be quite accurately held. It makes no difference how much or little the tie is plate cut. In a substantially plate cut tie, more wood will be removed automatically. If the tie is not plate cut very much, less wood will be removed, again automatically. The operator does not have to check the condition of the tie and then make a judgment as to how much wood to remove. Rather, the machine, once set, will do it automatically. Further, the upper and lower limits of where the wood removal must take place are well spaced and may amount to something on the order of ¾ of an inch, which gives the machine a little leeway. In short, the cut does not have to be highly accurate.

The method and apparatus does not lift the rails up, so the surface is not disturbed. It does not apply a large side thrust to the rails, so the line is not spoiled. The tie plates can be easily pushed into the crib space at the same time so no extra step or complication is involved in getting the tie plates out. The cutting or crunching action is not affected by the grain of the wood so the wood removal is accurate and even from side to side.

In this particular form shown, the wood cutting unit also raises the chips to a certain level so that some sort of a wood-disposal unit may be inserted underneath which, when the jaws open, catches the falling wood and moves it off to a point of disposal, rather than dropping or leaving it on the right of way.

Since the high wood is removed from the center and only one end of the tie, the other end may be grasped by the extractor arm at the same time that the jaws are cutting through the high wood, rather than having to wait and perform these steps in sequence. This materially speeds up the machine. Precisely how and when the extractor arm drops the removed tie is not now considered important.

While a preferred form and several modifications have been shown, it should be understood that suitable additional modifications, changes, substitutions and alterations may be made without departing from the invention's fundamental theme.

The embodiments of the invention in which an exclusive property or privilege is claimed are defined as follows:

1. A method usable in removing plate cut ties from beneath tie plate supported rails of a railroad track, including the step of simultaneously removing the wood from the top of the tie and removing the tie plates from between the rails and ties.

2. The method of claim 1 further characterized in that the step of simultaneously removing the wood and the tie plates includes the steps of applying longitudinal wood-removing pressure to the sides of the tie adjacent the top thereof from one side only and counteracting such pressure on the other side so that the wood is removed all in one direction longitudinally, and applying the wood-removing pressure from one side of the tie plates without a counteracting pressure on the other side so that the tie plates will be pushed into the crib space between the ties at the same time that the wood is being removed.

3. The method of claim 1 further characterized in that the step of removing the wood includes removing the wood down to a level between the bottom of the rails and the bottom of the tie plates.

4. A method of removing plate cut ties from beneath tie plate supported rails of a railroad track, including the steps of removing the wood from the top of the tie in the area between the rails and on one end thereof, removing the tie plates from between the tie and the rails, grasping the tie by its other end, performing the wood-removing, tie plate removing and tie grasping steps generally at the same time, and drawing the tie laterally out from under the rails in a direction toward its other end.

5. The method of claim 4 further characterized in that the step of removing the wood from the top of the tie includes the step of removing the wood down to a level below the bottom of the rails and above the bottom of the tie plates.

6. The method of claim 4 further characterized in that the step of removing the tie plates includes applying longitudinal pressure to the tie plates at the same time that the wood is being removed so that the tie plates will be pushed into the space between the ties.

7. The method of claim 4 further characterized in that the steps of removing the wood and removing the tie plates are performed simultaneously.

8. The method of claim 4 further characterized in that the step of applying a lateral thrust to the tie to remove it includes grasping the tie by its other end and drawing it laterally out from under the rails.

9. The method of claim 4 further characterized in that the step of removing the tie plates from between the ties and the rails includes applying longitudinal pressure to the tie plates at the same time that the wood is being removed so that the plates will be pushed into the space between the ties.

10. The method of claim 4 further characterized in that the step of removing the wood includes applying longitudinal wood-removing pressure to the sides of the tie adjacent the top thereof.

11. The method of claim 10 further characterized in that the step of applying longitudinal wood-removing pressure includes applying such pressure from one side only of the tie and counteracting such pressure on the other side so that the wood is removed all in one direction longitudinally.

12. The method of claim 11 further characterized by and including the step of applying the wood-removing pressure to one side of the tie plates without a counteracting pressure on the other side so that at the same time the the wood is being removed, the tie plates will be pushed into the crib space between the ties.

13. The method of claim 12 further characterized by and including the step of applying longitudinal pressure to the side of each tie plate at spaced locations thereon on each side of the rail so that each tie plate will slide uniformly from on top of the tie into the space between.

14. The method of claim 8 further characterized by and including the step of raising the grasped outer end of the tie when it is partially withdrawn so as not to interfere with any adjacent obstacles to a height such that when the said one end of the tie comes out from under the near rail, the tie may be released and dropped clear of the track.

15. The method of claim 1 further characterized by and including the step of raising the thus removed wood vertically to a certain height above the track, and conveying the removed wood horizontally to a collection point.

16. The method of claim 15 further characterized by and including the step of collecting the removed wood at a point spaced longitudinally from the point of removal, and moving the collecting point down the track in step with the place where wood is being removed and ties withdrawn.

17. A method of removing ties from beneath railroad track rails supported by tie plates so as to disturb the level of the track the least, including the steps of removing the wood from the top of a tie to expose a new wood surface anywhere in the areas between the rails and on at least one end thereof down to a level below the bottom of the rails and above the bottom of the tie plates, removing the tie plates from between the tie and the rails thereby allowing ample leeway for lateral passage of the new wood surface past and beneath the rails, and thereafter applying a lateral thrust to the tie to force it out from under the rails.

18. The method of claim 17 in that wood is not removed from the other end of the tie, and further characterized in that the tie is removed by grasping it by said other end and drawing it laterally out from under the rails.

19. A method of removing ties from beneath tie-plate supported rails of a railroad track so as to disturb the level of the track the least, including the steps of removing the wood from the top of the tie by applying longitudinal wood-removing pressure to remove wood and expose a new wood surface in the areas between the rails and on at least one end thereof down to a level at least as low as the bottom of the rails, pushing the tie plates from between the tie and the rails longitudinally into the space between the ties at the same time that the wood is removed thereby affording leeway space for lateral movement of the new wood surface past and beneath the rails, and thereafter applying a lateral thrust to the tie to force it endwise out from under the rails.

20. The method of claim 19 further characterized in that the step of applying a lateral thrust to the tie to remove it includes grasping the tie by one end and withdrawing it laterally out from under the rails.

21. The method of claim 19 further characterized in that the step of applying longitudinal wood-removing pressure includes applying such pressure from one side only to the tie and counteracting such pressure on the other side so that the wood is removed all in one direction longitudinally.

22. The method of claim 19 further characterized by and including the step of applying the wood-removing pressure to one side of the tie plates without a counteracting pressure on the other side so that at the same time that the wood is being removed, the tie plates will be pushed into the space between the ties.

23. The method of claim 19 further characterized by and including the step of applying longitudinal pressure to the side of each tie plate at spaced locations thereon on each side of the rail so that each tie plate will slide uniformly from on top of the tie into the space between the ties.

24. The method of claim 20 further characterized by and including the step of raising the grasped outer end of the tie when it is partially withdrawn so as not to interfere with any adjacent obstacles to a height such that when the said one end of the tie comes out from under the near rail, the tie may be released and dropped clear of the track.

25. The method of claim 19 further characterized by and including the step of raising the thus removed wood vertically to a certain height above the track, and conveying the removed wood horizontally to a collection point.

26. The method of claim 25 further characterized by and including the step of collecting the removed wood at a point spaced longitudinally from the point of removal, and moving the collecting point down the track in step with the place where wood is being removed and ties withdrawn.

27. The method of claim 19 further characterized in that the step of applying a lateral thrust to the tie to remove it includes grasping the tie by one end at the same time that the wood is being removed, and thereafter drawing it laterally out from under the rails.

28. The method of claim 27 in that the wood is not removed from said one end, and further characterized in that the tie is removed by grasping it by the said one end and drawing it laterally out from under the rails.

29. A method of removing ties from beneath tie plate supported rails of a railroad track, including the steps of removing the wood from the top of the tie, applying a lateral thrust to the tie to force it out from under the rails, raising the thus removed wood vertically to a certain height above the track, and conveying the thus removed wood horizontally away from the tie location.

30. The method of claim 29 further characterized in that the step of removing the wood from the top of the tie includes removing the wood down to a level between the bottom of the rails and the bottom of the tie plates.

31. A method of removing plate cut ties from beneath the rails of railroad track, including the steps of removing the high wood from the top of the tie in the area between the rails and on one end only thereof, grasping the tie by its other end, performing the wood-removing and tie end grasping steps simultaneously, and drawing the tie laterally out from under the rails by its other end.

32. The method of claim 31 further characterized in that the step of removing the high wood includes removing the wood from the top of the tie down to a level between the bottom of the rails and the bottom of the tie plates.

* * * * *